US005839977A

United States Patent [19]

Maurer et al.

[11] Patent Number: 5,839,977

[45] Date of Patent: Nov. 24, 1998

[54] APPLIQUE FOR A HOCKEY STICK

[76] Inventors: Alexander M. Maurer; Richard A. Maurer, both of 13075 Portsmouth Dr., Carmel, Ind. 46032

[21] Appl. No.: 494,417

[22] Filed: Jun. 26, 1995

[51] Int. Cl.[6] ..... A63B 67/00

[52] U.S. Cl. ..... 473/446; 473/471; 473/560

[58] Field of Search ..... 473/563, 249, 473/250, 351, 352, 324, 329, 330, 331, 342, 334, 132, 189, 195, 190, 431, 361, 363, 471, 514, 235, 416; 273/348.4, 348.5, 412

[56] References Cited

U.S. PATENT DOCUMENTS

| | | | |
|---|---|---|---|
| 55,278 | 5/1866 | Kraeuter | 473/431 |
| 57,980 | 5/1866 | Kraeuter | 473/330 |
| D. 63,284 | 11/1923 | Challis | 473/431 |
| 1,094,599 | 4/1914 | Samson | 473/329 |
| 2,912,295 | 7/1959 | Gardner | 273/67 |
| 3,353,826 | 11/1967 | Traverse | 273/67 |
| 3,391,933 | 7/1968 | Cooper | 473/563 |
| 3,458,194 | 7/1969 | Coles | 473/563 |
| 4,084,818 | 4/1978 | Goupil et al. | 273/67 A |
| 4,172,594 | 10/1979 | Diederich | 273/67 |
| 4,181,306 | 1/1980 | Jepson | 473/342 |
| 4,413,825 | 11/1983 | Sasse | 473/331 |
| 4,488,721 | 12/1984 | Franck et al. | 273/67 A |
| 4,529,203 | 7/1985 | Ribaudo | 473/431 |
| 4,651,990 | 3/1987 | Profit | 273/67 A |
| 5,160,135 | 11/1992 | Hasegawa | 473/561 |
| 5,332,212 | 7/1994 | Susi | 273/67 A |

FOREIGN PATENT DOCUMENTS 0984420 2/1976 Canada .

*Primary Examiner*—Theatrice Brown
*Attorney, Agent, or Firm*—Bose McKinney & Evans

[57] ABSTRACT

An applique is disclosed for placement on a hockey stick for improving the engagement of the stick with a game piece. The applique includes a base member having a first surface and a second surface. An adhesive is provided on a second surface for adhesively attaching the second surface to the stick. An ordered array of substantially non-deforming protrusions or recesses are formed on the first surface for engaging a surface of a game piece, such as a hockey puck. The protrusions are designed to maximize the frictional engagement between the applique and the puck, to increase the user's ability to control the puck. In an alternate embodiment, an applique is disclosed having a series of direction influencing protrusions formed on the first surface for influencing the direction of deflection of the hockey puck off the first surface toward a predetermined direction. Protrusions are disclosed for use on a goalie's hockey stick to drive the puck downwardly toward the ice or street to aid the goalie in controlling the puck. Alternate protrusion types are also provided for use on a forward's stick, to influence the direction of deflection of a puck on the stick in a lift or spin when the puck is being handled or shot by the forward. In an alternate embodiment, an improved grip applique is provided, which is attachable to the handle of the stick to increase the user's ability to achieve consistent placement of his hand on the stick.

15 Claims, 7 Drawing Sheets

APPLIQUE FOR A HOCKEY STICK

I. TECHNICAL FIELD OF THE INVENTION

The present invention relates to sport equipment, and more particularly to an applique for use on a hockey stick for enhancing the user's ability to control a game piece, such as a hockey puck or hockey ball, with the hockey stick and to improve the user's ability to grip the hockey stick.

II. BACKGROUND OF THE INVENTION

For years, hockey type sports have been enjoyed and played by people throughout the world. Although ice hockey is the best known form of hockey played currently in the United States, other types of hockey exist, such as field hockey, and "street" or "in-line hockey" which is played using in-line roller skates or traditional roller skates, rather than blade bearing skates.

Although many variations in the sport exist, the common denominator which unites the potential users of the present invention is the "hockey stick". As used in this application, "hockey stick" refers to any stick or bat-like object that includes a handle portion that is gripped by the user at one end, and has a ground-engageable blade disposed at the other end.

Examples of known hockey sticks are shown in FIGS. 1 and 2. Stick 10 of FIG. 1 is a type of stick typically used by wings, centers and defensemen on a ice hockey team. Because wings, centers and defensemen use the same type of stick and use their sticks to perform generally similar functions, wings, centers and defensemen will be referred to collectively in this application as "forwards," and the hockey stick type typically used by them as "forward's sticks" 10. FIG. 2 shows a goalie's stick 12 which is used by a goalie on a hockey team. Each of the forward's hockey stick 10 and the goalie's hockey stick 12 includes a handle portion 14, 16, a ground-engaging blade 18, 20 and a "heel" or "shank" portion 22, 24, respectively. The shank portion 22, 24 is the area of the hockey stick where the respective handles 14, 16 join to the respective blades 18, 20.

The forward's hockey stick 10 and the goalie's stick 12 are generally similar. However, it will be noted that the length L and the width W of the blade of the goalie's hockey stick 12 are typically larger than that of the forward's stick.

For quite some time, it has been common practice to wrap a multi-purpose cloth tape around the blade of a hockey stick and the handle of the hockey stick. The multi-purpose cloth tape typically used is virtually identical to the tape used by some baseball players to wrap their bats and by some cyclists to wrap their handlebars. Originally, the primary purpose of wrapping the blade was to reinforce the blade to help prevent it from breaking when it struck a puck or the ice to thereby lengthen the useful life of the blade.

Several patents are known which disclose devices that seek to improve on the reinforcing qualities of tape by using alternative methods to strengthen the blade.

Diederich U.S. Pat. No. 4,172,594 discloses a hockey stick having a wooden blade, whose surface is reinforced with a fiberglass impregnated resin coating. Tape can then be placed over this coating.

Profit U.S. Pat. No. 4,651,990 relates to a hard plastic channel member that fits over the blade of a goalie's hockey stick to provide reinforcement for the blade. The channel member is overlain with tape to provide a control surface.

Franck U.S. Pat. No. 4,448,721 relates to a hockey stick made by an injection molding technique. The blade may include series of apertures that reduce the weight of the core. A pre-preg material (such as a kevlar/epoxy material) is molded around the core to provide additional strength to the blade.

Goupil, et al. U.S. Pat. No. 4,084,818 discloses a hockey stick having a blade that is overlain with fiberglass yarn, which is wrapped around the blade. The fiberglass yarn is then dipped into an epoxy bath. The epoxy bath dipped blade is then left to dry and harden for 24 hours.

Traverse U.S. Pat. No. 3,353,826 discloses the use of a tubular sock which is knitted of a strong yarn of nylon or fiberglass, together with very fine nylon filaments. The sock is sized to fit smoothly on the blade, and onto a few inches of the shank of the stick, when tightly stretched. Liquid plastic is then applied to the portion of the stick covered by the sock so as to imbed the sock and form a top coating thereon.

Many advances, such as those described above have found their way into currently manufactured hockey sticks. Most currently manufactured hockey stick blades include some sort of plastic, fiberglass or KEVLAR® coating to help strengthen the blade to prevent it from breaking. Alternatively, other sticks are designed with tubular aluminum handles having an open end into which the shank of a blade can be fitted, so that a broken blade can be removed from the handle, and a new blade inserted into the handle, so that the handle may be reused indefinitely.

In view of these advances, broken blades have become much less of a problem, and hence the need for tape to reinforce the blade to provide additional mechanical strength is greatly reduced. Most currently manufactured blades appear to have sufficient mechanical strength so as to make blade breaks a rarity.

The second function performed by the multi-purpose tape is to aid the user in puck control. As the wooden or fiberglass surface of a hockey blade typically has a lower coefficient of friction then the surface of adhesive cloth multi-purpose tape, the placement of tape on the blade of the stick tends to increase the coefficient of friction of the blade, which provides the blade with a "grippier" surface than an unwrapped blade. This "grippier" surface helps the hockey player to better maintain the puck on the stick when the player is catching the puck, advancing the puck, shooting the puck, or passing the puck.

Several known items of prior art exist that address this need for providing the blade of a hockey stick with an improved control surface.

Spratt Canadian Patent No. 984,420 discloses a hockey stick having a blade to which an adhesive is applied. While the adhesive is still wet, a grit material (e.g., sand) is then applied to the adhesive to provide a gritty surface to the stick.

Coles U.S. Pat. No. 3,458,194 discloses the use of a tape material having an adhesive side for attaching to a stick, and an outer surface comprised of a Velcro-like material. The purpose of this Velcro-like material is to improve the control of the puck on the blade.

Susi, et al. U.S. Pat. No. 5,332,212 relates to the use of a rubbery (soft plastic) coating for a hockey blade that is applied to the blade through an immersion or aerosol spray technique.

Gardner, et al. U.S. Pat. No. 2,912,245 discloses a hockey stick having a rubber coating molded onto the blade to simulate a tape surface. The rubber coating is applied by a molding process, wherein a strip of uncured rubber is laid on face of the mold. The blade is then laid upon the strip of uncured rubber. A second strip of uncured rubber is laid upon the blade. The mold is then closed with both faces of the mold being provided with ridges for molding ridges into the first and second strips of uncured rubber. The blade and the sides of the two strips of uncured rubber may be provided with an adhesive. After the mold is closed, it is subjected to a 300° F. temperature and between 3 and 5 tons of pressure for a duration of between about 3 and 3.5 minutes. The rubber strip is cured during this molding process.

Although the above discussed, Sprat, Coles, Susi, and Gardner references do address the issue of providing a surface on a hockey blade which seeks to improve over known cloth adhesive type multi-purpose tape, room for improvement still exists. In particular, the need still exists for providing a surface for a hockey stick that provides a user with a greater degree of control than that disclosed in any of the references described above. Additionally, there is a need for an improved control surface for a hockey stick blade that can be applied to the blade by the user in a manner that is familiar to the user and is similar to the manner in which the user currently applies tape to the blade.

It is therefore one object of the present invention to provide an applique which creates an improved control surface on a hockey stick blade, and which can be applied to the hockey stick blade by the user, in a manner similar to the manner in which adhesive tape is currently applied to hockey blades and without the need for adhesive sprays, grit applicators, curing molds, or other non-user friendly application techniques.

Another deficiency of the devices discussed above, and conventional hockey tape is that they provide a generally "neutral" stick surface, which does not tend to influence the angle at which a puck deflects off of the surface of the stick. Although a neutral deflection is preferred in many situations, a need also exists for a surface that will tend to influence the angle of deflection of the puck to thereby impart better directional predictability.

Therefore, it is also an object of one embodiment of the present invention to provide a surface for a hockey stick blade that helps to influence a puck striking the surface to deflect from the surface in a predetermined direction.

A further deficiency with current known hockey sticks is that few provide a completely suitable gripping surface on the handle of the stick. In order to provide a better gripping surface for the user, most hockey players currently wrap the end of the handle of the stick with a multi-purpose cloth adhesive tape, which is usually the same tape used by the player to wrap the blade of the stick. In a manner similar to the manner in which it functions with the blade, the application of a multi-purpose adhesive tape to the end of the handle increases the co-efficient of friction of the wrapped portion of the handle, which thereby helps the user's gloved hand to hold onto the stick better. Those familiar with the large, somewhat cumbersome protective gloves worn by hockey players will appreciate the difficultly that a player often has holding onto a stick with his gloved hand.

Although the application of a multi-purpose tape to the handle does provide a benefit to the player, as it helps the user to increase the frictional engagement between his glove and the handle of the stick, room for improvement exists. In particular, room for improvement exists in providing a grip that not only provides the user with a relatively high degree of frictional engagement between his hand and the handle of the hockey stick, but also helps to position his fingers consistently on the stick. It is therefore another object of the present invention to provide an applique for use on the handle of a hockey stick which both improves the user's ability to grip and retain the stick, and also improves the user's ability to obtain a consistent placement of his hand on the handle of the stick.

III. SUMMARY OF THE INVENTION

In accordance with the present invention, an applique is provided for placement on a hockey stick for improving the engagement of the stick with a game piece. The applique comprises a base member having a first surface and a second surface, and means for adhesively attaching the second surface to the stick. An ordered array of substantially non-deforming protrusions are formed to extend above the first surface for engaging the surface of a game piece.

Preferably, the protrusions are generally hemispherical in shape, and are sized for engaging recesses formed in the surface of the game piece, such as the diamond shape recesses typically found along the side surface of a hockey puck. The hemispherical protrusions are sized and positioned to maximize the probability of the insertion of the protrusions of the applique into the recesses of the puck, to maximize engagement of the puck and stick and thereby provide an enhanced coefficient of friction therebetween.

In an alternate embodiment of the present invention, the ordered array of protrusions are replaced with an ordered array of recesses formed in the base member, to extend below the first surface for engaging protrusions on the side surfaces of the puck.

In another alternate embodiment, an applique is provided for placement on a hockey stick for improving the engagement of the stick with a game piece. The applique comprises a base member having a first surface and a second surface and means for adhesively attaching the second surface to the stick. Direction influencing means are disclosed on the first surface for influencing the direction of deflection of the game piece off the first surface, toward a predetermined direction.

In still yet another alternate embodiment, an applique is provided for placement on a hockey stick for improving the user's grip of the stick. The applique comprises a base member having a first surface and a second surface, and a means for adhesively attaching the second surface to the stick. A longitudinal ridge member is formed to extend above the first surface. Preferably, the size and position of the ridge member are chosen so that when the applique is wrapped around the stick in a side-by-side relation, the ridge members of adjacent portions of the applique provide sufficient room to receive a user's finger therebetween.

One feature of the present invention is that it contains an ordered array of substantially non-deforming protrusions, that are formed to extend above the outer surface of the applique for engaging a surface of a game piece. Preferably, the protrusions are sized and positioned to maximize the engagement of the protrusions with recesses formed in the surface of a game piece, such as a hockey puck. This feature has the advantage of increasing the degree of frictional engagement between the stick blade and the game piece. This increased frictional engagement helps the player to better maintain the puck on the stick, thereby giving to the player an enhanced ability to control the puck on the stick. Additionally, this enhanced frictional engagement can increase the ability of the user to spin or lift the puck when shooting the puck.

Another feature of a preferred embodiment of the present invention is that an applique is provided having direction influencing means disposed on the surface for influencing the direction of deflection of the game piece off the stick toward a predetermined direction. This feature has the advantage of enabling the user to better direct the puck in an intended or desired direction and to reduce the likelihood that the puck will travel in an unintended or undesired direction.

The issue of what constitutes a "desired direction" will likely vary among types of players (e.g, goalies and forwards) and may also vary from player to player based on individual preferences and circumstances. However, several common preferred directions exist. For goalies, it is desirable to influence a puck to deflect downwardly off a stick blade toward the ice. By directing the puck downwardly, it will engage the ice, and preferably stop only a short distance in front of the goalie, so that the goalie can retrieve it.

It is usually undesirable for a goalie to deflect the puck upwardly. An upwardly deflected puck is more difficult for the goalie to control, and hence, stands a greater likelihood of being controlled by an opposing player. Additionally, a puck which is deflected upwardly may continue in its same direction of travel, and thereby cause the goads to) lose control of the puck. As such, the applicants have found that, for goalies, it is preferable to influence the puck to deflect in a downward direction, and undesirable to deflect the puck in an upward direction.

Preferably, the direction influencing means also increases the applique's ability to absorb energy from the puck, thus reducing its deflection energy off of the stick, and hence reducing the distance that the puck will travel off the blade after striking it.

Different considerations exist with respect to the direction in which a forward, such as a wing, center, or defenseman, may wish to deflect a puck. As a forward is often using his stick to advance the puck toward the opponent's goal, he may wish to use a control surface that will cause the puck to behave in a manner that makes it difficult for an opponent, such as the opponent's goalie, to stop it. As a general rule, most goalies find it more difficult to stop an airborne puck than one which is traveling along the surface of the ice. Additionally, it is often desirable to lift the puck off the ice as a lifted puck that is traveling through the air tends to maintain its speed better, and is less likely than one traveling along the ice to slow down through frictional engagement with the ice. As such, a forward may wish to have a control surface on his stick that influences the puck to deflect upwardly when shot, and thereby lift off the ice.

Additionally, many players might prefer to have a control surface which influences the puck to "spin" when hit, as a spinning puck tends to travel more accurately than a non-spinning puck, thus increasing the likelihood that the player shooting a spinning puck will score when the puck is shot on goal.

As a third alternative, some players may desire that the control surface influence the puck to bounce downwardly toward the ice, as this type of deflection would help to enable the player to maintain a better control of the puck as he advances it down the ice or attempts to pass it to one of his teammates.

It is a further feature of the present invention that the direction influencing means can include two or more series of direction influencing means for providing two or more zones on the stick, with each zone having a pattern thereon to influence the puck in a different direction. This feature has the advantage of enhancing the player's ability to control the puck by enabling the stick to improve several facets of the player's control of the puck. For example, a player may wish to have a first zone near the top of the blade that influences the puck to deflect downwardly toward the ice. This downward deflection would help the player to control the puck when he was receiving airborne passes from his teammates or otherwise trying to gain control of an airborne puck when taking it away from an opponent. However, he may also wish to have a direction-influencing pattern on the bottom portion of his stick that would cause the puck to lift and spin when he was shooting the puck. In such case, the user may prefer a direction-influencing applique having a pair of zones, each of which is intended to influence the puck to travel in a different direction.

It is also a feature of one embodiment of the present invention that an applique is provided for placement on a hockey stick handle for improving the user's grip on the handle of the stick. This feature has the advantage of giving the user a more secure grip, which helps to prevent the user's hand from sliding up and down the length of the stick during use. Additionally, the grip helps to position the player's hand more consistently, to enable the player to grip the stick in a more consistent position, thus aiding the player in his stick control and ability to control the game piece with the stick.

Additionally, it is a further feature of the present invention that the applique is preferably made from a relative "soft durometer" polyvinyl chloride (PVC) material. The use of this PVC material has the advantage of making the applique water repellent, and helps to make the blade "softer," thus giving the player better "feel" and better control over the puck.

These and other features of the present invention will become apparent to those skilled in the art upon review of the drawings and detailed description set forth below of that which is perceived presently to be the best mode of practicing the invention.

IV. BRIEF DESCRIPTION OF THE DRAWINGS

V. DETAILED DESCRIPTION

Figures 1, 2, 3:
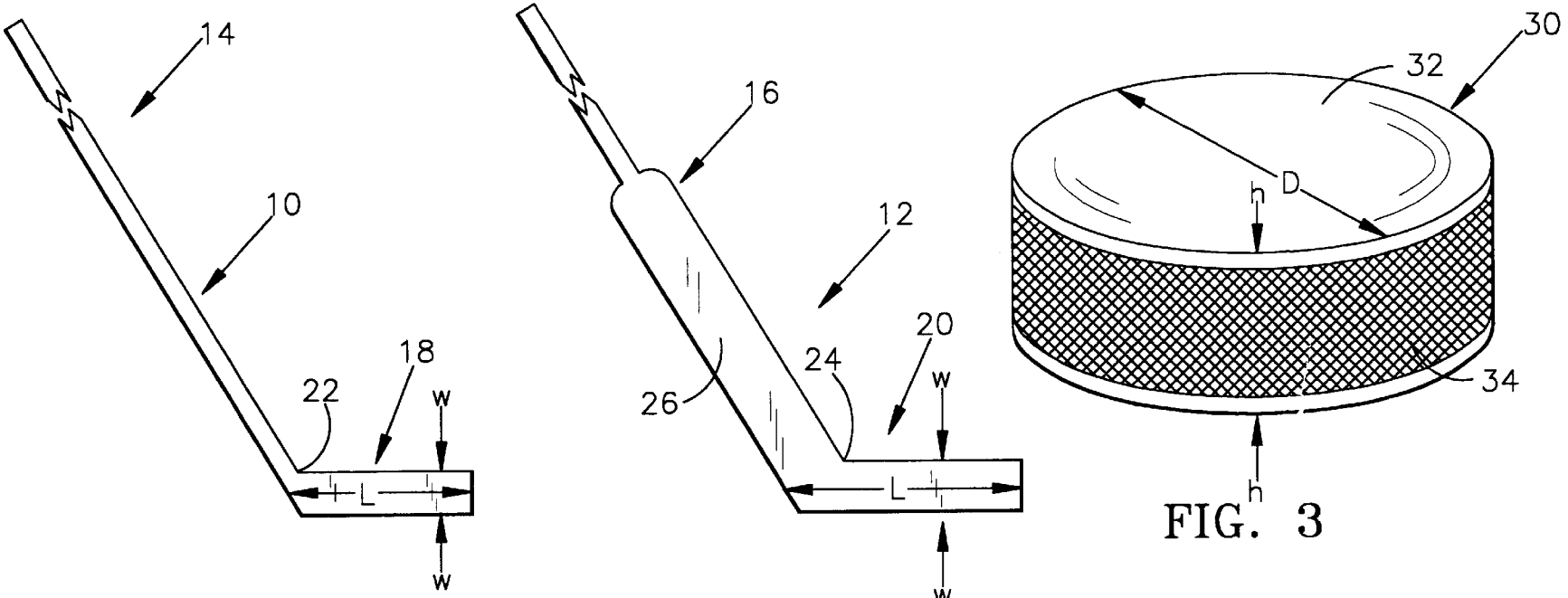
FIG. 1 is a side plan view of a forward's hockey stick.
FIG. 2 is a side plan view of a goalie's hockey stick.
FIG. 3 is a perspective view of a hockey puck.

Turning now to FIGS. 1–3, hockey sticks 10, 12 and a hockey puck 30 are shown which are integral to the understanding of the applique of the invention.

FIG. 1 shows a forward's hockey stick 10 of the type normally used by a defenseman, wing, or center. The forward's hockey stick has a handle portion 14 and a blade portion 18. According to current ice hockey equipment rules, the blade 18 of the forward's hockey stick 10 can have a width W—W of between 2 and 3 inches, and a length L—L of less than 12.5 inches. A forward's hockey stick also includes a shank (heel) portion 22 which comprises that area wherein the blade 18 meets the handle 14.

The goalie's hockey stick 12 includes a handle 16, a blade 20 and a shank portion 24. According to current ice hockey equipment rules, the goalie's stick 12 can have a blade 20 having a maximum width W of less than 3.5 inches, and a length L of less than 15.5 inches. The widened lower portion 26 of the handle 16 is used by the goalie to help block pucks.

For in-line skate ("street") hockey events, forward's sticks and goalie's sticks similar to those shown in FIG. 1 and 2 are used. For events sanctioned by one sanctioning body (USA HOCKEY IN-LINE), the dimensions used for street hockey sticks are identical to those for ice hockey sticks. However, for events sanctioned by another sanctioning body (THE NATIONAL IN-LINE HOCKEY ASSOCIATION (NIHA)), different dimensions are specified. For NIHA events, the forward's stick may have a blade having a length of less than 12 inches, and a width of between 1.75 and 3.25 inches. A goalie's street hockey stick may have a blade having a length of less than 15.5 inches and a width of less than 3.5 inches. Additionally, some models of forward's in-line hockey sticks also include a horizontally extending array of holes disposed across the upper portion of the blade of the stick.

Although the applique of the present invention can be applied to a hockey stick (e.g., 10, 12) and used with any game piece, such as a ball of some sort, the most common game piece is a puck, such as hockey puck 30. Hockey puck 30 is a disk-shaped solid, vulcanized rubber game piece having a circular top surface 32, a circular bottom surface 33 (FIG. 5) and a cylindrical sidewall 34. The diameter D of each of the circular top surface 32 and bottom surface 33 is preferably about 3 inches. The cylindrical sidewall has a height, H—H (FIG. 3) of approximately 1 inch.

Figure 4:
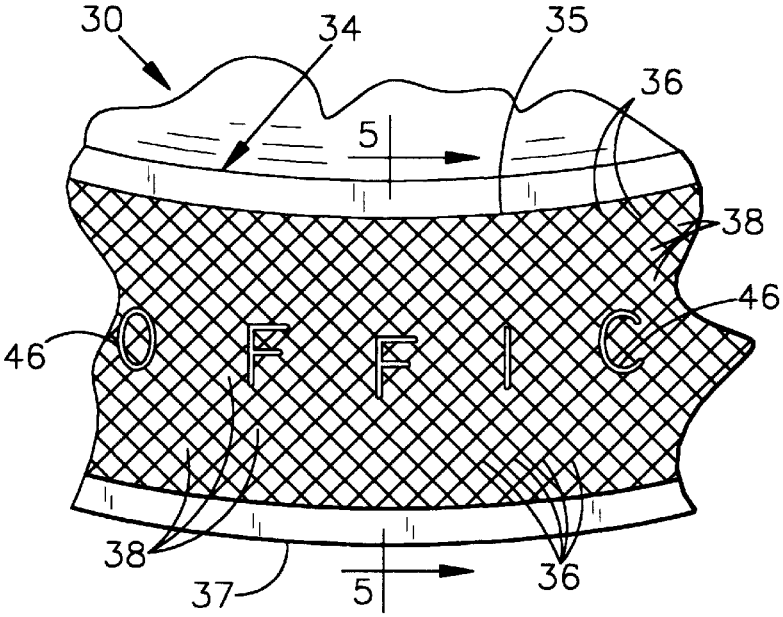
FIG. 4 is an expanded view of a portion of a side surface of a hockey puck.
Figure 5:
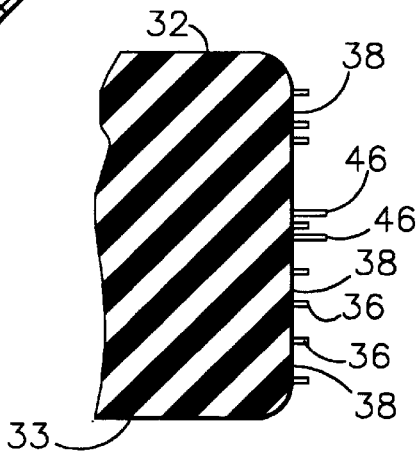
FIG. 5 is a sectional view taken along lines 5—5 of FIG. 4.

As best shown in FIGS. 4 and 5, the cylindrical side surface 34 has a cross-hatched pattern of raised ridges 36 that define a series of diamond-shaped recesses 38 therebetween. A pair of circumferential ridges 35, 37 extend circumferentially around the side surface 34 of the puck 30, and are disposed at the border of patterned areas to define the boundary of the patterned area of side surface 34. Although almost all hockey pucks have this pattern of ridges 36 and diamond-shaped recesses 38, the sizes of the ridges 36 and recesses 38 vary from manufacturer to manufacturer. The applicant knows of at least three different sized patterns used currently. Known hockey pucks that are manufactured in Czechoslovakia have a ridge 36 and recess 38 pattern which contains 32 recesses 38 per inch in a height dimension (e.g., along lines H—H of FIG. 3), and 28 rows of recesses 38 per inch in a circumferential direction. Comparable pucks made in Canada and Slovakia, by contrast, contain 24 recesses per inch in a height dimension H—H, and 20 recesses per inch in a circumferential direction. Additionally, certain pucks known to the applicant that are made in China have a pattern containing 20 recesses per inch when measured in a height direction H—H, and 20 recesses per inch when measured in a circumferential direction.

These spacing differences create recesses in the different types of pucks, which have slightly different shapes and sizes. These differences in the shape and size of the recesses add to the challenge of designing an applique that will work well with all of the different types of pucks and their different cross-hatched pattern configurations.

As best shown in FIGS. 4 and 5, most hockey pucks 30 include secondary protrusions which are sized and shaped differently than the protrusions 36 formed by the cross-hatched pattern. These protrusions primarily comprise letters 46, such as the letters "O-F-F-I-C" shown in FIG. 4. These letters 46 have a different shape and position than the cross-hatched ridges 36. As best shown in FIG. 5, these secondary protrusions 46 also tend to have a greater height than the cross-hatched ridges 36, and thus stick out further from the side surface 34 of the puck 30.

Figure 6:
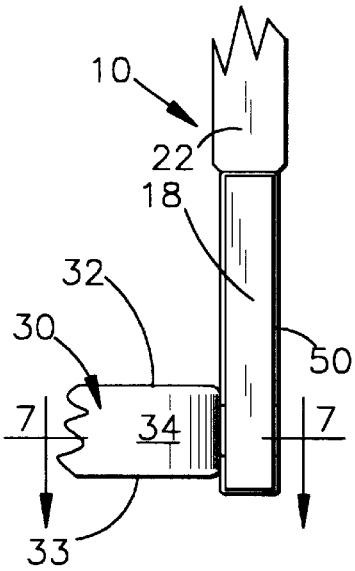
FIG. 6 is an end view of a hockey stick and blade, and side view of a puck in engagement therewith.

As best shown in FIG. 6, the applique 50 is designed to be placed on the blade 18 of a hockey stick, to enhance the user's ability to control the puck 30 with the blade 18, by maximizing the frictional engagement between the blade 18 and the puck 30. As a result of this enhanced frictional engagement, the user is better able to spin, lift and control the puck 30.

The applique 50 can take on a variety of forms. Preferably, the applique 50 comprises a ribbon-like base member 54 having a first surface 56 and a second surface 60. The applique 50 of the present invention can be generally similar in size, shape and flexibility to currently used multi-purpose cloth tapes, and can be provided in a roll, similar to the rolls in which tape is currently provided. Preferably, the applique (in its roll-tape form) has a width of about 0.75 inches, and is formed into rolls having a length per roll of between about 4 and 20 yards in length. Because of the formed surface features (discussed below) of the applique 50, it will likely have a thickness which is slightly greater than conventional roll tapes. The applique 50 can be manufactured in a variety of colors.

Alternately, the applique 50 can be provided as a "patch" format that is manufactured on a sheet, and then is applied in one piece over the front, back (or both) faces of the hockey stick blade. The patch form of the applique 50 would be especially useful in conjunction with the "multi-zone" applique 288 shown in FIG. 34, and would also be useful to provide the application configuration 116 shown in FIG. 16.

As most current hockey blades include fiberglass reinforcement, the tape need not be wrapped around the blade to provide additional reinforcement, as this additional reinforcement is unnecessary. As such, the applique 50 of the present invention can be applied only to one face of the blade if so desired, such as by placing the applique 50 in its "patch" form on only one face. It is envisioned that forwards will still choose to place the applique 50 over both sides of their blade, as most forwards use both sides of the blade to control the puck 30. However, goalies typically only use one face of their blade, and as such, may choose not to place the applique 50 on the back side of the blade.

The second surface 60 of the applique includes an adhesive for adhesively attaching the base member 54 to the surface of the blade 18. The adhesive used can be similar or identical to the adhesive used currently with multi-purpose hockey tapes.

The first surfaces of most of the embodiments of the present invention include a plurality of substantially non-deforming protrusions that are formed on the first surface 56 of the applique. (The ridges 102, 104, 106 of the embodiment shown in FIGS. 13–15 may not quite constitute "protrusions.") Except for the embodiment shown in FIG. 10, the protrusions 62 are all formed to extend above the first surface 56 of the base member 54.

As will be discussed in more detail below, the protrusions 62 can assume a variety of forms and shapes, many of which are discussed in connection with various embodiments shown in the drawings. However, several common features unite all of the embodiments. First, the protrusions 62 are disposed on the first surface of the base member 54 of the applique 51 in an ordered array. The array is ordered to maximize the frictional engagement between the protrusions 62 and, hence, the first surface 56 of the applique 50 with the side surface 34 of the puck 30. In the embodiments shown in FIGS. 7 and 8–9, the protrusions are arrayed to maximize the probability of the insertion of the protrusions 62 of the appliques 51, 69 into the recesses 38 of the puck 30. In the embodiments shown in FIG. 10, a series of depressions are used which are placed in an ordered array to maximize the probability of the protrusions 36 of the side surface 34 of the puck 30 being received into the cross-hatched recesses 66 formed on the applique 50. One feature of the protrusions and recesses is that the enhanced frictional engagement that they provide help the user to lift and spin the puck when the user shoots the puck.

Figure 7:
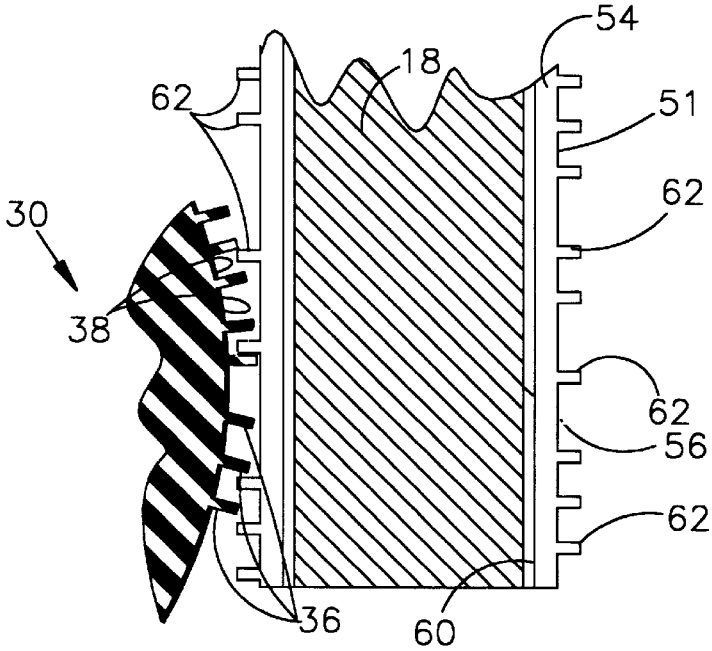
FIG. 7 is a sectional view taken generally along lines 7—7 of FIG. 6.
Figure 8:
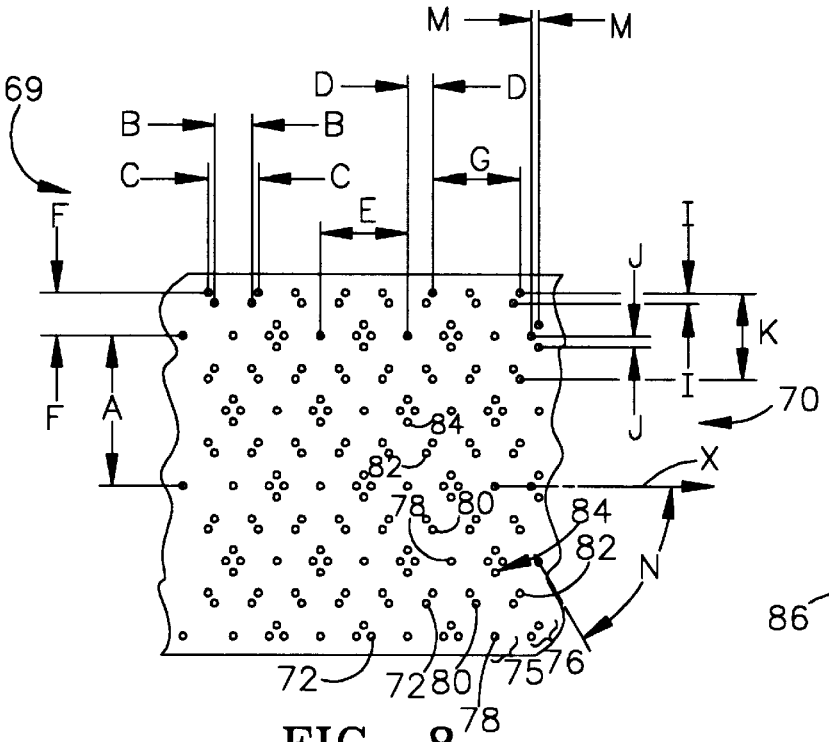
FIG. 8 is a greatly enlarged, largely schematic view of a protrusion pattern of the present invention.
Figure 9:
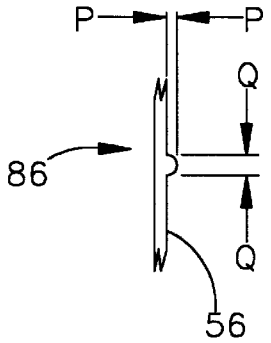
FIG. 9 is an even further enlarged side view of a single protrusion of the pattern shown in FIG. 8.

A second common feature which unites the protrusions, is that they are substantially non-deformable. Preferably, the protrusions and base member of the embodiments shown in FIG. 7–9 are formed to have a durometer hardness of somewhere between about 75 and 95, Shore A. As will be appreciated, protrusions of this hardness are not completely non-deformable, such as would be the case with protrusions which comprise a sand grit. Conversely, protrusions 62 are not substantially deformable when engaging a puck surface, as one might expect from the "hooks" or "eyes" typically associated with a VELCRO cloth material. Rather, the protrusions 62 should be substantially stiff enough to engage the recesses 38, and in some cases, to become nested in the recesses 38, but still be soft enough to give the user some "feel", and to reduce the velocity of deflection of the puck on the applique (e.g., 51) when the puck 30 strikes the applique bearing blade.

As is best shown in FIG. 7, the protrusions 62 are preferably received in the recesses 38 of the side surface 34 of the puck 30. Because of the particular pattern (discussed in connection with FIGS. 8 and 9), not every protrusion 62 is likely to find a corresponding recess 38, nor are all recesses 38 likely to have a mating protrusion 62.

The appliques 51, 69 shown in FIGS. 7–9 are intended primarily for use by forwards on their hockey sticks 10. Because of the function performed by a forward, the appliques shown in FIGS. 7–9 are intended primarily to produce a somewhat "neutral" direction influencing characteristic of the blade when the blade is being used to "catch" a puck, such as when a forward is using his blade to catch a passed puck. Additionally, the appliques of FIGS. 7–9 are intended to have a primarily "neutral" direction influencing means when the forward is using the stick to control the puck, such as when he is advancing the puck down the ice. The enhanced frictional engagement between the puck and the stick that is provided by the appliques 51, 69 of FIGS. 7–9 help to enable the user to better control the puck as the forward is advancing it down the ice, by making the applique, and hence the stick, "grippier."

An applique 69 having a most preferred protrusion pattern 70 is shown in FIGS. 8 and 9. The protrusion pattern 70 has been found by the applicants to be configured to maximize the likelihood that the protrusions (e.g., protrusion 72) will become engaged within the recesses 38 of the pucks of all of the three patterns (Czechoslovakian, Canadian/Slovakian, and Chinese) discussed above.

The drawing shown in FIG. 8 shows the pattern 70 as being enlarged 5 times from its actual size. In actuality, the pattern 70 shown in FIG. 8 will have a length and width each of ⅞ths inch. The preferred dimensions for the pattern shown in FIG. 8 are given below, with reference to the letters shown in FIG. 8.

| Letter Designation | Dimension |
|---|---|
| A | 0.433 inch |
| B | 0.107 inch |
| C | 0.144 inch |
| D | 0.070 inch |
| E | 0.254 inch |

-continued

| Letter Designation | Dimension |
|---|---|
| F | 0.125 inch |
| G | 0.250 inch |
| I | 0.030 inch |
| J | 0.032 inch |
| K | 0.250 inch |
| M | 0.021 inch |
| N | 60° |
| P | 0.01 inch |
| Q | 0.02 inch |

The protrusions generally are arrayed in a repeating pattern of first rows of protrusions and second rows of protrusions. Although the assignment of protrusion groups to "rows" is somewhat arbitrary, for purposes of this discussion, it will be assumed that the rows extend at approximately 60° angles (angle N) from a longitudinal axis X of the pattern. Although the preferred angle N at which the rows are canted is 60°, the rows can be angled anywhere generally between about 45° and 70° from axis X. The rows 75, 76 are preferably disposed at about 0.1 inches apart (B—B) to leave some free space therebetween.

The first and second rows 75, 76 each comprise an ordered array of protrusions in a repeating pattern, wherein the first row and the second row are repeated throughout the particular "pattern", and, in fact, throughout the entire length of the patch or tape roll which comprises the applique 50. First row 75 includes a series of two protrusion groups, including a first protrusion group 78 and a second protrusion group 80. The first protrusion group 78 comprises a single protrusion, and the second protrusion group 80 comprises a pair of closely spaced protrusions. As one moves up row 75, it will be noticed that row 75 comprises a repeating pattern of first and second protrusion groups 78, 80 throughout the pattern.

Second protrusion row 76 also comprises an alternating array of first and second protrusion groups 82, 84. The first protrusion group 82 comprises a pair of closely spaced protrusions, and the second protrusion group 84 comprises a "diamond-shaped" array of four protrusions.

A single protrusion 86 is shown in cross section in FIG. 9 as being generally hemispherical or "pimple" shaped in configuration and having a height P—P to cause the protrusion to extend approximately 0.1 inches above the first surface 56 of the applique 50. The diameter of the protrusion Q—Q is approximately 0.02 inches. The size and hemispherical shape of the protrusions is believed by applicant to maximize the ability of the protrusion 86 to become inserted into a recess 38 formed in the side surface 34 of the hockey puck 30, regardless of whether the hockey puck uses a "Canadian/Slovakian", "Czechoslovakian", or "Chinese" side surface pattern. In tests conducted by the applicant, using the pattern discussed above, the applicant found that the particular pattern greatly improved the frictional engagement between the applique 50 and the side surface 34 of the hockey puck, and resulted in an approximately 69% increase in the average friction coefficient, when compared to a multi-purpose such as is typically used currently on hockey stick blades 18.

Although the protrusions discussed in connection with applique 69 have their most obvious utility when used in connection with an ice hockey puck, the applicants have found that the applique 69 works very well with smooth surfaced game pieces such as street hockey pucks and street hockey balls. When used with smooth surfaced game pieces, applique 69 is believed to increase the player's control of the game piece by increasing the frictional co-efficient between the game piece and the applique 69, thereby giving the user an enhanced ability to lift and spin the game piece. This enhanced ability to lift, spin and control the game piece also occurs with ice hockey pucks.

As stated above, the protrusions, such as protrusion 82, should be substantially non-deformable, and have a durometer hardness of preferably between about 75 and 95, Shore A. To create these protrusions, having this hardness, the base material 54 should be preferably made from a PVC type material, having a thickness of between about 0.08 and 0.14 inches. An adhesive is applied to the second side surface in a conventional manner. A release liner will be attached to the second surface, which is removed before the second surface of the applique is applied to the blade of the stick. The protrusions are formed on the first side surface by embossing the protrusions onto the base member.

Figure 10:
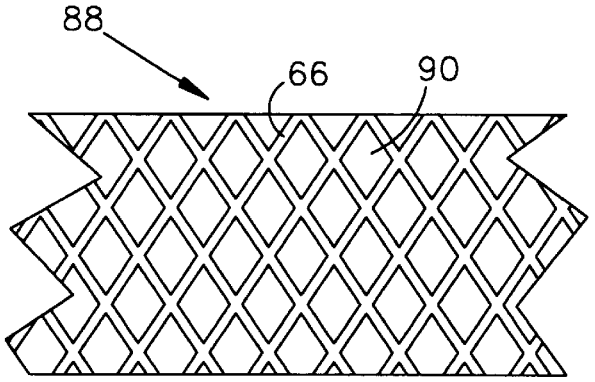
FIG. 10 is a top view of a segment of an alternate embodiment applique of the present invention.

An alternate embodiment pattern for an applique 88 is shown in FIG. 10. The applique 88 shown in FIG. 10 includes a cross-hatched pattern of recesses 66 which extend downwardly, generally below the level of the first surface 90. The recesses 66 are formed in a cross-hatched pattern and are sized and positioned for maximizing their reception of the cross-hatched series of ridges 36 formed on the side surface 34 of the hockey puck 30. As will be appreciated, the recesses 66 should be slightly wider, and slightly deeper, than the corresponding ridges of the side surface 34 of the hockey puck 30, to maximize the ability of the cross-hatched recesses 66 to receive the cross-hatched protrusions 36 of the hockey puck 30.

Figure 11:
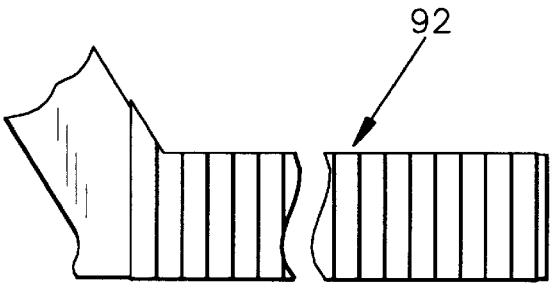
FIG. 11 is a side view of a hockey stick showing a "top to bottom" wrapping pattern.
Figure 12:
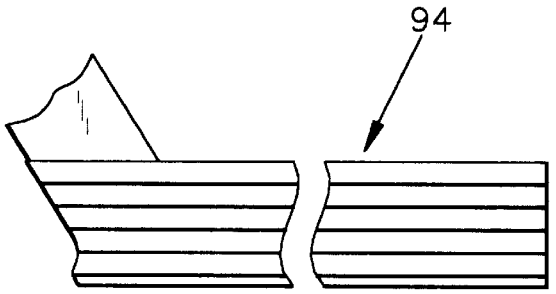
FIG. 12 is a side view of a hockey stick showing an alternate, side-to-side wrapping pattern.

FIGS. 11 and 12 show various wrapping patterns that can be used with appliques of the present invention that are provided in tape roll form. It is believed by the applicant that the more traditional vertical wrap pattern 92 will likely be used by most players, and especially by ice hockey players. However, the alternate, "horizontal wrap" 94 will likely be preferred by street hockey players so that the row of holes 95 across the upper portion of the blade will continue to remain exposed, and not be covered up by the applique.

Figure 13:
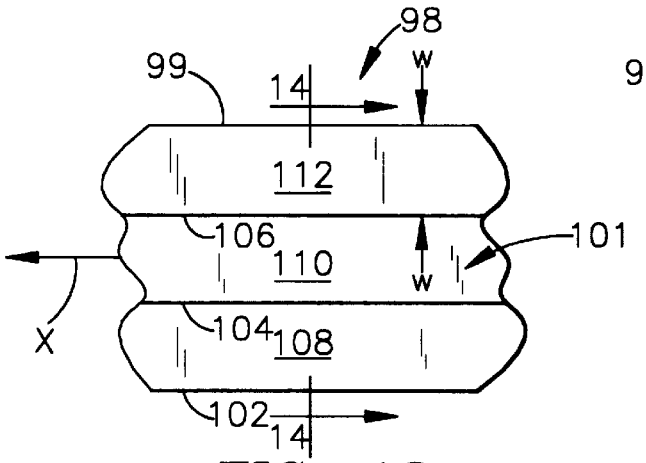
FIG. 13 is a top view of an alternate embodiment applique of the present invention.

Another alternate embodiment for an applique 98 is shown in FIG. 13. Applique 98 includes base member 99 having a first surface 101, and a second surface 103. Second surface 103 has an adhesive applied thereto, for enabling the second surface 103 to be adhesively attached to the surface of a hockey stick. The first surface 101 includes a series of direction influencing means for influencing the direction of deflection of the game piece (puck 30) off the first surface 101 toward a predetermined direction. The direction influencing means comprise a series of ridges, including first ridge 102, second ridge 104, and third ridge 106. The first, second and third ridges, 102, 104, 106, are preferably disposed in a parallel relation both to each other, and to the major axis X of the applique 98. The ridges, 102, 104, 106, define a series of parallel, incrementally raised steps, including first step 108, second step 110 and third step 112. The second step 110 has a relatively raised level, compared to the first step 108, and the third step 112 has a relatively raised level when compared to the second step 110. Preferably, the second step 110 is between about 0.01 and 0.04 inches thicker than the first step 108, and the third step 112 is between about 0.01 and 0.04 inches thicker than the second step 110. Additionally, each of the steps 108, 110, 112 has a width W (FIG. 13) of between about 0.2 and 0.5 inches.

Most preferably, the first step 108 has a thickness (including its base member) of about 0.008 inches; the second step 110 has a thickness of about 0.028 inches; and the third step 112 has a thickness of about 0.048 inches. Additionally, each of the steps 108, 110, 112 has a width W of approximately 0.333 inches. Thus, for an applique, such as applique 98 having a 3-step, 108, 110, 112 configuration, the entire width of applique 98 would be approximately 1 inch. Additionally, the angle formed by the plane of the second surface 103, and the average rise of the steps 108, 110, 112 of the first surface 101 would be approximately 4°.

The ridges 102, 104, 106 and steps 108, 110, 112 help to deflect a puck in direction which is generally downwardly toward the ice. It has been found by the applicant that the size and position of the ridges 102, 104, 106 help to contribute to this downward deflection through the engagement of the ridges 102, 104, 106 with the ridges 35, 36 and 37 of the puck. Further, the 40 overall angle of the applique helps ensure that the puck 30 does not strike the applique flushly.

Preferably, applique 98 is formed by an extrusion process, with the base member being made from a PVC type material having a durometer hardness of preferably between about 65 and 85, Shore A.

Figure 14:
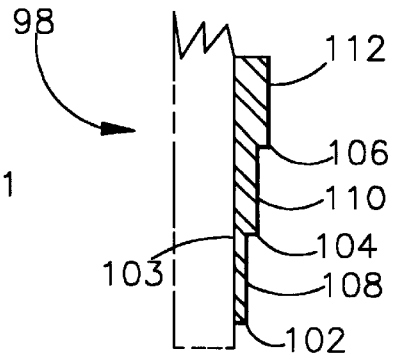
FIG. 14 is a sectional view taken generally along lines 14—14 of FIG. 13.

The pattern shown in FIGS. 13 and 14 differs somewhat in purpose from the pattern 70 shown in FIGS. 8 and 9.

The primary purpose of the protrusion pattern 70 (FIG. 8) is to increase the frictional engagement between the applique 50 and the side surface 34 of the hockey puck. However, the engagement between the applique 69 and the side surface 34 of the hockey puck 30 is intended to be somewhat neutral and is not necessarily designed to influence the direction in which a puck will deflect off the surface of the applique 69. As such, a puck striking an applique 69 made with the pattern 70 (FIG. 8) is no more likely to be influenced to deflect upwardly than it is to deflect downwardly, and is no more likely to influenced to bounce to the left, then it is to the right.

Notwithstanding this apparent neutrality of pattern 70 in the direction of deflection when a puck strikes the pattern, the applicants have found that a puck shot with a stick 10 containing pattern 70 will tend to be influenced to lift and spin. It is believed that this tendency to lift and spin is caused by a combination of the enhanced frictional engagement of the puck and pattern 70, and the arcuate line of swing usually employed by a player shooting a puck.

Figure 15:
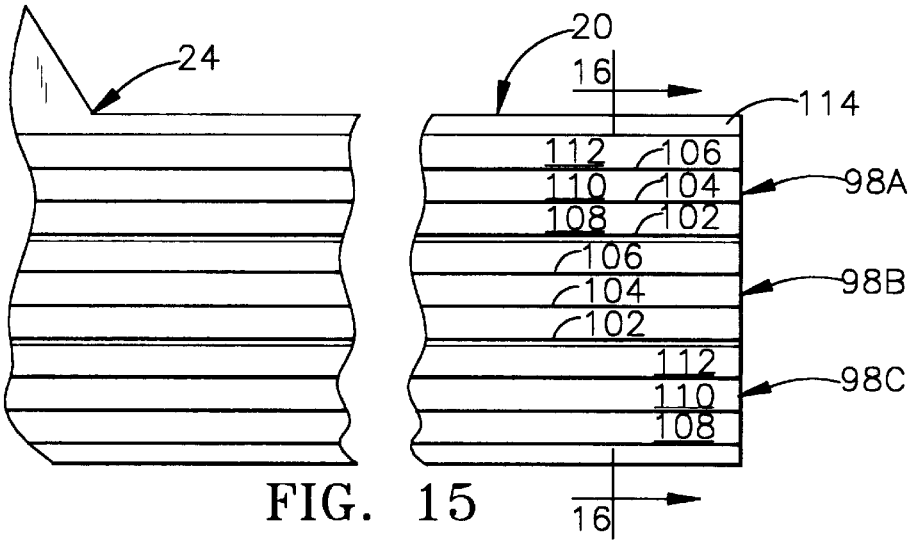
FIG. 15 is a side view of a hockey stick blade showing the applique of FIG. 13 thereon.

However, the pattern 98 shown in FIGS. 13–15 is designed to influence the direction in which a puck will deflect, and the velocity of its deflection due to the softness of the applique. The particular pattern 98 shown in FIG. 13 is intended, when positioned on a hockey stick blade 20, such as shown in FIG. 15, to influence a puck striking the surface of the applique bands 98A, 98B, 98C in a downward direction toward the surface of the ice.

The job of a goalie is to deflect oncoming pucks which are shot at the goal. From the goalie's perspective, it is most advantageous if the shot can be stopped "soft" wherein the goalie retains the puck against his stick, so that he can either trap it to prevent a goal, or otherwise pass or direct it to one of this teammates. Goalies strive to avoid the situation wherein the puck bounces upwardly and becomes airborne. For these reasons, the goalies are motivated to deflect the puck downwardly onto the ice (or street) to better maintain control thereby.

The applique 98 shown in FIGS. 13–15 is designed to increase the likelihood that a puck striking the applique 98 will be deflected downwardly, when compared to known hockey tapes. The combination of the progressively thicker top portion (e.g., step 112), and ridges 102, 104, 106, help to capture the side and "corners" of the puck to drive it downwardly toward the ice. As such, the ridges 102, 104, 106 and steps, 108, 110, 112 comprise direction influencing vehicles for influencing the direction of a puck which strikes them to deflect off of the ridges 102, 104, 106 and steps, 108, 110, 112 in a predetermined direction. Although all pucks which hit the ridges 102, 104, 106 and steps 108, 110, 112 will not be deflected downwardly, the steps and ridges help to influence the puck to deflect downwardly, and increase the likelihood that a puck will deflect downwardly.

Turning now to FIG. 15, the applique G8 is shown as being applied to a blade 20 of a goalie's stick. Three bands 98A, 98B and 98C, of the applique 98 are applied generally horizontally across the front face 114 of the blade 20, and extend all the way between the heel and toe of the hockey stick blade. Although not shown, the applique 98 can be applied to the back side face and handle portion of the stick.

Figure 16:
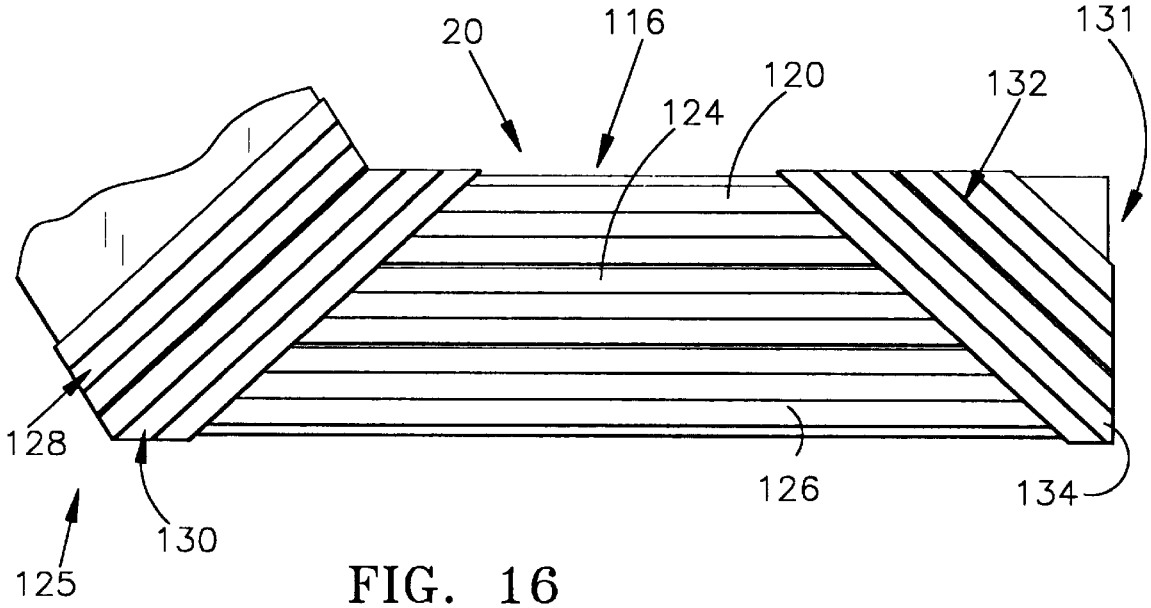
FIG. 16 is an side view of a hockey stick blade containing the applique of FIG. 13 showing an alternate wrapping pattern.

An alternate wrapping pattern 116 is shown in FIG. 16, as including a first strip 120, second strip 124 and third strip 126 which are disposed generally horizontally along the blade 20 of the hockey stick. However, the heel end 125 of the hockey stick includes a fourth strip 128 and a fifth strip 130 that are positioned at a diagonal to horizontal. Similarly, the toe end 131 includes a sixth strip 132 and a seventh strip 134 that are positioned at a diagonal to the horizontal. This particular wrap arrangement is believed to be beneficial to the goalie by influencing pucks which deflect off the stick 20 to bounce downwardly toward the ice, and also toward the middle of the stick. As will be appreciated, the horizontally disposed first, second and third strips, 120, 124, 126 will cause the puck to deflect downwardly toward the ice. The diagonal strips 128, 130, 132, 134 will cause the puck to bounce both downwardly toward the ice, and inwardly toward the center of the stick.

As is true in any sport, it is likely that users of the appliques will find an endless variety of patterns in which to apply the appliques to their sticks to achieve both perceived and real functional and aesthetic advantages.

FIGS. 17–31 show a variety of alternate embodiment appliques which include protrusion arrays and patterns that are designed to influence the direction in which a puck deflects off the surface of the applique, to influence the puck to move in a predetermined direction. Many of the appliques shown in FIGS. 17–23 are intended for use primarily with forward's hockey sticks 10. As such, the "deflection" that will be influenced will primarily be the deflection of the puck off the applique when the user shoots or passes the puck with the stick 10. This is in contrast to the primary "deflection" of the direction influencing means of pattern 98 which is used on a goalie's stick. As is discussed above, the primary deflection that is influenced by pattern 98 is the deflection off the applique 98 when a puck is shot at the goalie, and he is using his stick 12, and the applique 98 thereon to stop the puck or to direct it to one side of the net or to his teammates.

The appliques shown in FIGS. 17–23 are intended primarily for use by forwards on their hockey sticks 10. Because of the function performed by a forward, the appliques shown in FIGS. 17–23 have incorporated direction influencing protrusions which are intended primarily to effect the deflection of the puck when shot by the user, such as by inducing the puck to spin or to lift off the ice and become airborne. Additionally, as much of the function performed by a forward is to advance the puck down the ice while controlling it on the blade 18 of the stick 10, the appliques shown in FIGS. 17–23 are also intended to help increase the frictional engagement between the surface 34 of the puck 30 and the applique (and hence hockey stick) to enable the user to better control the puck as he is advancing it down the ice.

The appliques shown in FIGS. 24–31 are intended primarily for use by goalies. As such, these appliques have direction influencing protrusions whose primary purpose is to drive the puck downwardly toward the ice to help the goalie maintain control of the puck, and to prevent the puck 30 from becoming airborne if it deflects from the goalie's stick 12. Additionally, the protrusion patterns shown on the appliques of FIGS. 24–31 are also intended to help increase the frictional engagement between the applique and the side surface 34 of the hockey puck, to help the goalie better control the puck 30 on his stick 12.

Figure 17:
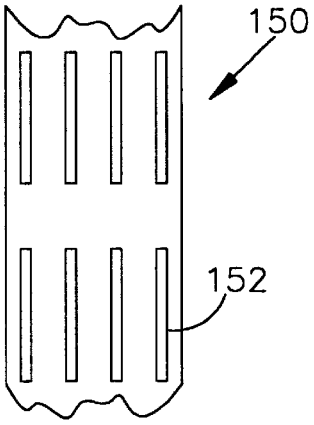
FIG. 17 is a top view of a segment of an alternate embodiment applique.

The applique 150 shown in FIG. 17 contains a plurality of generally parallelly disposed longitudinal ridge members 152. The ridge members 152 are not continuous, but generally comprise ridge member segments.

Figure 18:
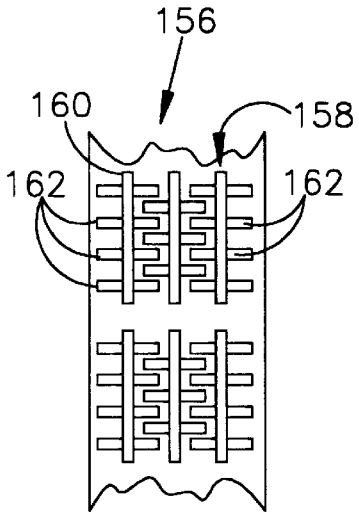
FIG. 18 is a top view of a segment of an alternate embodiment applique.

The applique 156 shown in FIG. 18 is intended to give both spin and lift to a puck which is deflected from its surface. The applique 156 includes a series of protrusions 158, which each include a longitudinal trunk portion 160, and series of lateral, generally linear branch portions 152, which are connected to, and extend from the trunk portions 160.

Figure 19:
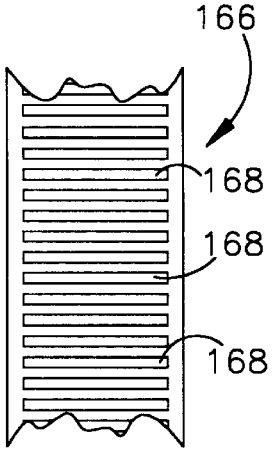
FIG. 19 is a top view of a segment of an alternate embodiment applique.

The applique 166 shown in FIG. 19 includes an array of generally linear, laterally extending ridge type protrusions 168. It is believed that the protrusions 168 of applique 166 will help to influence a puck being shot from the stick to move in a pre-determined, spinning direction.

Figure 20:
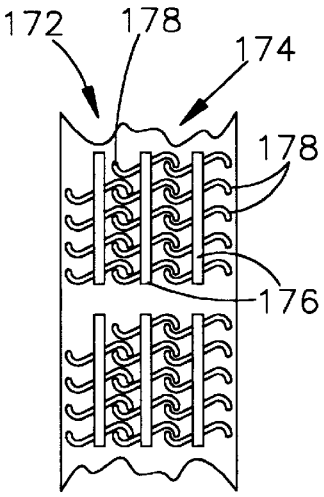
FIG. 20 is a top view of a segment of an alternate embodiment applique.

Applique 172 of FIG. 20 includes a series of protrusions 174 having a longitudinal trunk portion 176, and a series of generally "s"-shaped laterally extending branch portions 158 which are connected with the trunk portions 176, and extend generally laterally therefrom.

Figure 21:
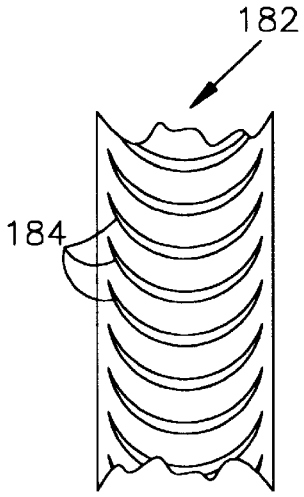
FIG. 21 is a top view of a segment of an alternate embodiment applique.

Applique 182 of FIG. 21 includes a series of generally laterally extending, crescent-shaped protrusions 184.

Figure 22:
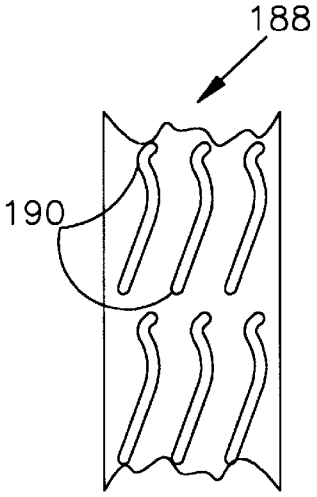
FIG. 22 is a top view of a segment of an alternate embodiment applique.

FIG. 22 shows an applique 188 having a series of generally longitudinally extending "s"-shaped protrusions 190 which are believed by applicant to influence a puck being deflected off the stick to spin.

Figure 23:
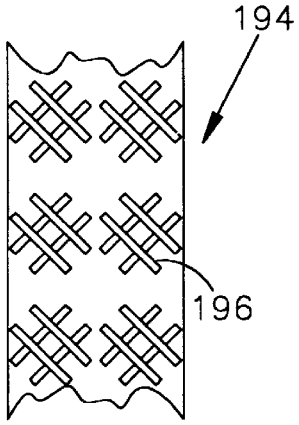
FIG. 23 is a top view of a segment of an alternate embodiment applique.

The applique 194 of FIG. 23 is been intended primarily to help increase the frictional engagement between the applique 194 and the side surface 34 of the hockey puck 30, to better enhance the user's control of the puck. Applique 194 includes an array of cross-hatched ridge type protrusions 196. As stated above, the applique shown in FIGS. 24–31 are intended primarily for use by goalies, and as such are intended to influence the puck to be directed downwardly when deflected off of the applique, and also to enhance the goalie's control of the puck.

Figure 24:
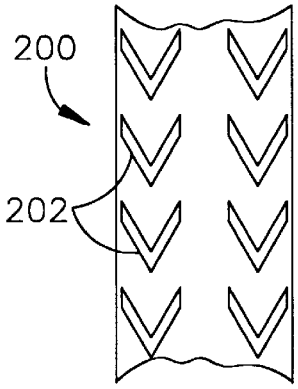
FIG. 24 is a top view of a segment of an alternate embodiment applique.

FIG. 24 shows an applique 200 that is intended primarily to drive the puck downwardly toward the ice, by including a series of chevron-shaped protrusions 202.

Figure 25:
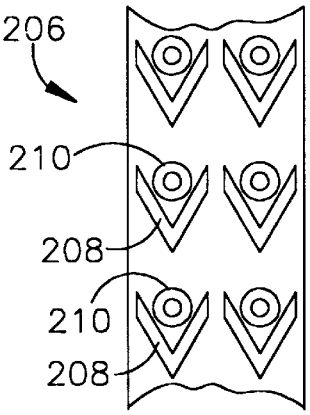
FIG. 25 is a top view of a segment of an alternate embodiment applique.

FIG. 25 discloses an applique 206 having a plurality of chevron-shaped protrusions 208 and a series of hemispherical, or flattened hemispherical "pimple" shaped protrusions 210, which are nested within the chevron protrusions 208.

Figure 26:
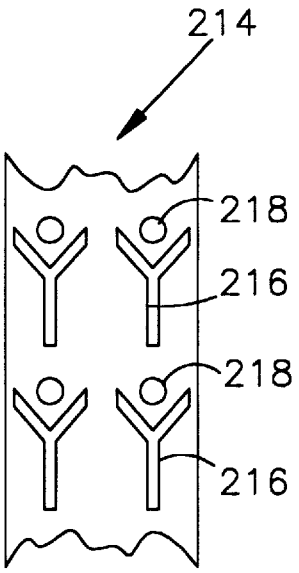
FIG. 26 is a top view of a segment of an alternate embodiment applique.

Applique 214 of FIG. 26 includes a series of "y"-shaped protrusions 216, each of which include a companion hemispherical, or flattened hemispherical "pimple" shaped protrusion 218 that nests within the branches of the y-shaped protrusions 216.

Figure 27:
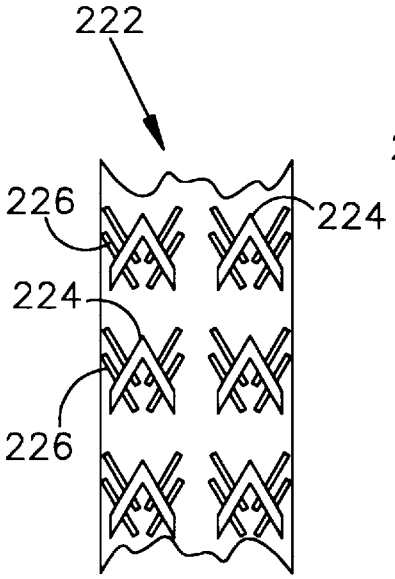
FIG. 27 is a top view of a segment of an alternate embodiment applique.

The applique 222 of FIG. 27 contains a series of chevron shaped protrusions 224, wherein each of the chevron shaped protrusions 224 includes a series of branches 226 extending therefrom. As shown, the branches may extend generally perpendicular to the extent of the chevron leg to which they are attached, or alternately, may be disposed at some other angle.

Figure 28:
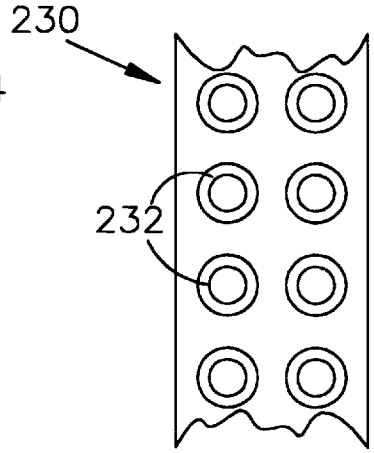
FIG. 28 is a top view of a segment of an alternate embodiment applique.

The applique 230 of FIG. 28 contains a series of hemispherical, or flattened hemispherical, "pimple" shaped protrusions 232.

Figure 29:
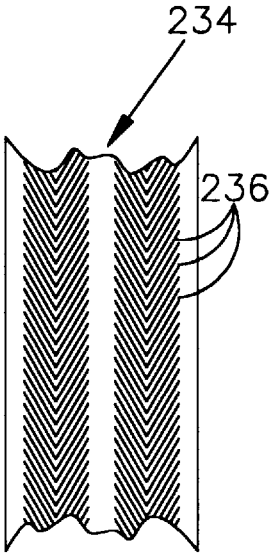
FIG. 29 is a top view of a segment of an alternate embodiment applique.

The applique 234 of FIG. 29 includes an array of closely spaced, truncated chevron shaped protrusions 236.

Figure 30:
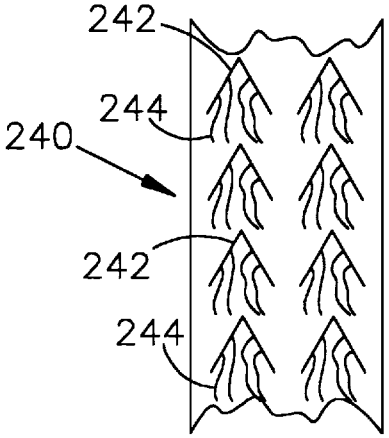
FIG. 30 is a top view of a segment of an alternate embodiment applique.

Applique 240, which is shown in FIG. 30, includes a series of chevron shaped protrusions 242. Each of the chevron shaped protrusions 242 includes a series of "s"-shaped branches which extend in a generally longitudinal direction.

Figure 31:
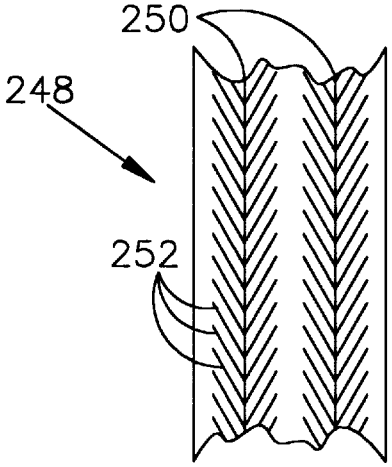
FIG. 31 is a top view of a segment of an alternate embodiment applique.

The applique 248 shown in FIG. 31 includes a series of longitudinal trunk-shaped protrusions 250. A plurality of chevron-shaped branches 252 are attached to each of the longitudinal trunks 250.

Figure 32:
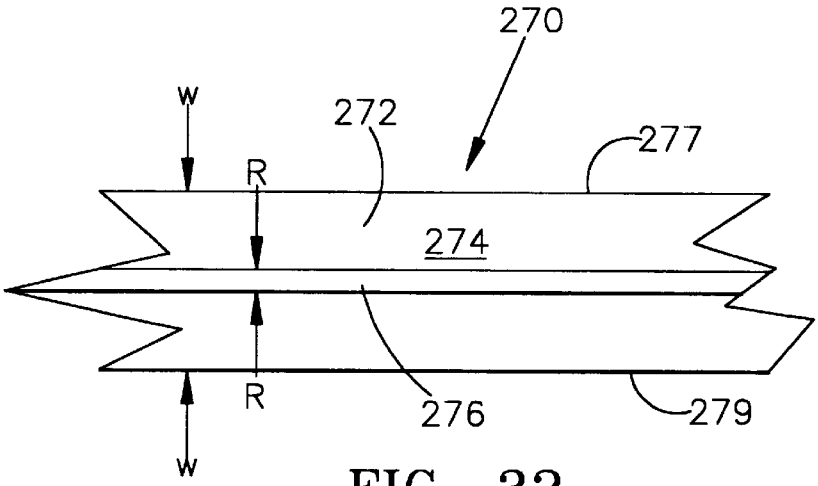
FIG. 32 is a top view of a segment of an grip-enhancing applique of the present invention.
Figure 33:
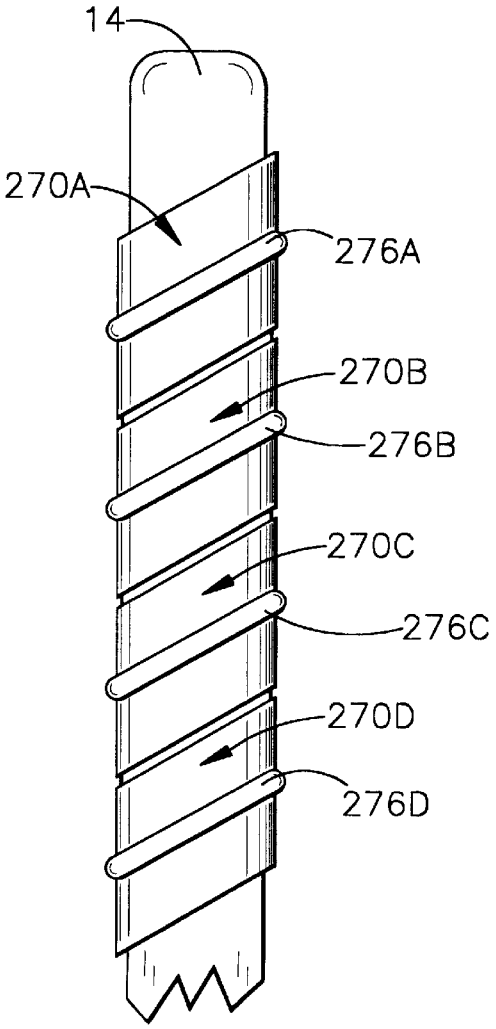
FIG. 33 is a front view of a handle of a hockey stick showing the applique of FIG. 32 wrapped there around.

An applique 270 for improving the user's grip on the handle 14 of a hockey stick is shown in FIGS. 32 and 33. The applique 270 includes a base member 272 having a second surface (not shown) to which an adhesive is applied, for adhesively attaching the base member 272 to the handle 14 of the hockey stick. The applique 270 also includes a first surface 274 having a longitudinally extending ridge member 276 formed thereon. If applique 270 is provided as a "roll" in a manner similar to conventional hockey tape, the ridge member 276 would preferably extend throughout the entire length of the applique 270. The applique 270 has a width W—W of approximately one inch. The ridge 276 is preferably centrally disposed along the longitudinal axis of the applique 270, so that it is equally spaced from each of the two sides 277, 279 of the applique. The ridge, has a height of preferably about ⅛th inch, and a width R'—R' of approximately ⅛th inch.

As best shown in FIG. 33, the applique 270 is placed in a series of adjacent, or slightly overlapping bands on the handle 14 of the hockey stick, near the end of the handle 14. In FIG. 33, four bands, 270A, 270B, 270C and 270D of applique 270 are shown as being applied in an adjacent, non-overlapping relationship on the handle 14. When so placed, the handle includes four ridges 276A, 276B, 276C and 276D, with each corresponding to their respective band 270A–D of the applique 270 and with each extending at about a 45° angle to longitudinal axis of the handle. When so positioned, the distance D between adjacent ridges (e.g., 276A and 276B; and 276C and 276D) is approximately one inch. This width is chosen as it provides the user with enough room to generally place one gloved finger between each adjacent ridge pair. For example, in the illustration shown in FIG. 33, the user would preferably place his "pinky" finger between ridges 276A and 276B; his third finger between ridges 276B and 276C; his second finger between ridges 276C and 276D; and his index finger below ridge 276D.

The existence of the ridges helps to prevent the user's gloved hands from slipping up and down on the hockey stick. Additionally, the ridges help to cause the user to place his fingers in a consistent position on the hockey stick. This consistency in the positioning of the user's fingers should help to improve the user's ability to manipulate the stick and to shoot the puck 30.

Figure 34:
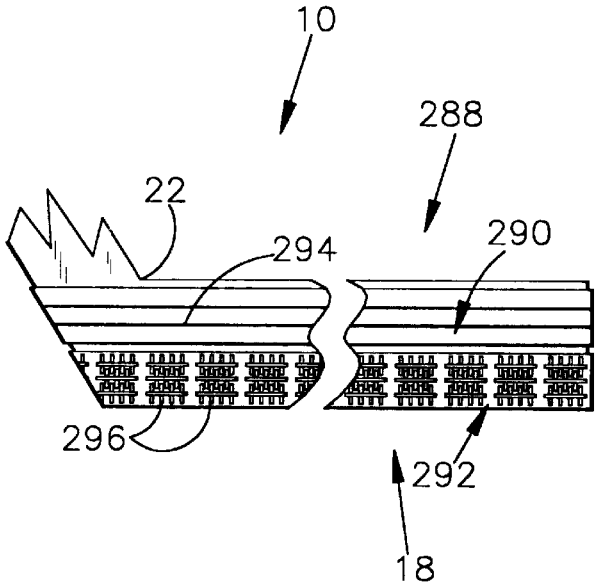
FIG. 34 is a side view of an alternate embodiment wrapping pattern, for creating an applique having two distinct zones for influencing the direction of deflection of a puck.

An applique configuration 288 is shown in FIG. 34, which includes a first applique portion 290 and a second applique portion 292. The first applique portion 290 includes a series of first direction influencing means 294 for influencing the puck to deflect from the applique 290 in a first predetermined direction. A second applique portion 292 includes a series of second direction influencing means 296 which are designed for influencing the puck to deflect off the second applique portion 292 in a second predetermined direction, which may or may not be different than the first predetermined direction in which first applique portion 290 deflects the puck.

The first applique portion 290 can be an applique similar to applique 98, which is shown in FIGS. 13–16. As discussed above, the purpose of the direction influencing means 294 of an applique, such as appliques 98 or 290, is to drive the puck downwardly toward the ice. The second direction influencing means 296 of the second applique portion 292 are similar to the respective protrusions 158 and applique 156 shown in FIG. 18. As discussed in connection with FIG. 18, the purpose of the second direction influencing means 296 is to induce a puck to move in a predetermined "spin" direction, and to cause the puck further to lift off the ice when shot.

The two zone applique configuration 288 shown in FIG. 34 might be used by a forward on the blade 18 of his hockey stick, to enable the forward to achieve two different desired goals with his applique 288. The upper, first applique portion 290 would tend to drive the puck downwardly towards the ice. This would help to improve the forward's control of pucks that the forward is receiving from teammates, or intercepting from other players. The bottom, second applique portion 292 would help the forward to direct the puck in an intended, "lift and spin" direction when the forward is shooting the puck at the goal, or passing it to teammates. As such, through the use of the two zone protrusion, the user could obtain two different sets of advantages, which would help the user in two different circumstances encountered during the play of a hockey game.

Although the invention has been described in detail with reference to the illustrated preferred embodiments, variations and modifications exist within the scope and spirit of the invention as described and as defined in the following claims.

What is claimed is:

1. An applique for placement on a hockey stick blade for improving the engagement of the hockey stick blade with a hockey puck, said puck having a cylindrically vertically extending peripheral surface, said surface having an ordered array of recesses therein, said hockey puck being pushable along a playing surface by the hockey stick, the applique comprising (1) a base member having a first surface and a second surface, (2) means for adhesively attaching the second surface to the hockey stick blade, and (3) an ordered array of substantially non-deforming protrusions extending above the first surface for engaging said recesses in said hockey puck, wherein the engagement of the protrusions with the recesses facilitates temporary maintenance of the engagement between the hockey stick blade and the recess containing surface of the hockey puck when the hockey stick is pushing said hockey puck along the playing surface.

2. The device of claim 1 wherein said array of protrusions is ordered to maximize the probability of the insertion of the protrusions of the applique into the recesses in the puck.

3. The device of claim 2 wherein the ordered array of protrusions comprises a repeating pattern of first rows of protrusions and second rows of protrusions, the first rows of protrusions being different from the second rows of protrusions.

4. The device of claim 3 wherein the first rows of protrusions comprise a repeating pattern of first and second protrusion sets, and the second rows of protrusions comprise a repeating pattern of first and second protrusion sets.

5. The device of claim 4 wherein (a) the first protrusion set of the first rows comprises a set containing a single protrusion, (b) the second protrusion set of the first rows comprises a set containing a pair of protrusions, (c) the first protrusion set of the second rows comprises a set containing a pair of protrusions, and (e) the second protrusion group set comprises a set containing four protrusions.

6. The device of claim 5 wherein the applique includes a longitudinal axis, and the rows extend at an angle from the longitudinal axis of the applique of between about 45 degrees and 75 degrees, and the distance between adjacent rows is about 0.1 inches.

7. The device of claim 1 wherein the protrusions extend about 0.01 inches above the second surface, and have a durometer hardness of between about 75 and 95, Shore A.

8. The device of claim 1 wherein the ordered array of protrusions comprises repeating, alternating rows of protrusions including a first row of protrusions and a second row of protrusions, the first and second rows each including a series of protrusion sets.

9. The device of claim 8 wherein the protrusion sets of at least one of the first and second rows comprises an alternating series of first protrusion sets and second protrusion sets, said protrusion sets being positioned to maximize the probability of insertion of the protrusions into recesses of the game piece.

10. The device of claim 1 wherein the applique comprises a flexible tape.

11. The device of claim 10 wherein the game piece surface includes an ordered array of protruding portions, and the applique includes an ordered array of recesses that are sized and positioned to maximize the engagement of the recesses with the protruding portions of the hockey puck.

12. An applique for placement on a hockey stick for improving the engagement of the hockey stick blade with a game piece, said game piece having a cylindrical vertically extending peripheral surface, said surface having an orderly array of recesses therein, said applique comprising (1) a base member having a first surface and a second surface, (2) means for adhesively attaching the second surface to the hockey stick blade, and (3) an ordered array of substantially non-deforming protrusions extending above the first surface for engaging the game piece surface, wherein the protrusions are generally hemispherical in shape, and are sized for engaging the recesses in said game piece surface.

13. An applique for placement on a hockey stick blade for improving the engagement of the hockey stick blade with a hockey puck said hockey puck having a cylindrical vertically extending peripheral surface, said surface having an ordered array of recesses therein the hockey puck being pushable along a playing surface by the hockey stick, a hockey stick having a blade the applique comprising (1) a base member having a first surface and a second surface, (2) means for adhesively attaching the second surface to the hockey stick blade, and (3) an ordered array of substantially non-deforming protrusions extending above the first surface for engaging the recesses in said surface, wherein the ordered array of protrusions comprises a repeating pattern that includes a first row of protrusions and a second row of protrusions, the first row of protrusions being different from the second row of protrusions.

14. An applique for placement on a hockey stick blade for improving the engagement of the hockey stick blade with a hockey puck, said puck having a cylindrical vertically extending surface, said surface having an ordered array of protrusions therein said hockey puck being pushable along a playing surface by a hockey stick having a blade, said applique comprising (1) a base member made from a non-water absorbent material having a first surface and a second surface, (2) means for adhesively attaching the second surface to the hockey stick blade, and (3) an ordered array of non-deforming protrusions extending above the first surface for engaging said recesses in said puck surface, said ordered array of protrusions comprising a repeating pattern of first rows of protrusions and second rows of protrusions, the first rows of protrusions comprising a repeating pattern of first and second protrusion sets, and the second rows of protrusions comprising a repeating pattern of first and second protrusion sets, the protrusion sets of the first rows of protrusions being different than the protrusion sets of the second rows of protrusions, wherein the engagement of the protrusions with the recesses facilitates temporary maintenance of the engagement between the hockey stick blade and the hockey puck when the hockey stick is pushing the hockey puck along a playing surface.

15. An applique for placement on a hockey stick blade for improving the engagement of the hockey stick blade with a hockey puck said puck having a cylindrical vertically extending surface, said surface having an ordered array of recesses therein, said hockey puck being pushable along a playing surface by the hockey stick, said applique comprising (1) a base member having a first surface and a second surface, (2) means for adhesively attaching the second surface to the hockey stick blade, and (3) an ordered array of substantially non-deforming protrusions having a durometer hardness of between about 75 and 95, Shore A, the protrusions extending about 0.01 inches above the first surface for engagement with the recesses in said hockey puck, wherein the engagement of the protrusions with the recesses facilitates temporary maintenance of the engagement between the hockey stick and the recess containing surface of the hockey puck when the hockey stick is pushing hockey puck along the playing surface.

* * * * *